US009330637B1

(12) United States Patent
McCabe

(10) Patent No.: US 9,330,637 B1
(45) Date of Patent: May 3, 2016

(54) BI-DIRECTIONAL LOADING CLAMP IMPROVEMENT

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 0 days.

(21) Appl. No.: 14/866,734

(22) Filed: Sep. 25, 2015

(51) Int. Cl.
*G10D 3/14* (2006.01)

(52) U.S. Cl.
CPC . *G10D 3/14* (2013.01); *G10D 3/146* (2013.01)

(58) Field of Classification Search
CPC ..... G10D 3/146
See application file for complete search history.

(56) References Cited

U.S. PATENT DOCUMENTS 4,497,236 A * 2/1985 Rose ..... G10D 3/04 84/267
4,724,737 A * 2/1988 Fender ..... G10D 3/146 84/297 R
5,986,191 A * 11/1999 McCabe ..... G10D 3/146 84/313
6,563,034 B2 * 5/2003 McCabe ..... G10D 3/146 84/298
7,009,096 B2 * 3/2006 Hirayama ..... G10D 3/146 84/312 R
7,470,841 B1 * 12/2008 McCabe ..... G10D 3/146 84/312 R
8,536,430 B2 * 9/2013 McCabe ..... G10D 3/14 84/312 R
8,536,431 B1 * 9/2013 McCabe ..... G10D 3/146 84/298
9,123,312 B2 * 9/2015 McCabe ..... G10D 3/146
2015/0279341 A1 * 10/2015 Maslarov ..... G10D 3/146 84/313

* cited by examiner

*Primary Examiner* — Robert W Horn

(57) ABSTRACT

A bi-directional clamping device for string musical instruments includes a forward end closer the nut and a rearward end further the nut fashioned to be operable to receive a string inserted essentially unimpeded in a first direction, the first direction extending in the direction of the strings typically from the rearward end of the clamping device towards the nut and further fashioned to be operable to optionally receive a string inserted essentially unimpeded in a second direction, the second direction extending in the direction of the strings typically towards the rearward end of the clamping device from the nut. The arrangement further allows for larger diameter strings with taper cores, etc. to be clamped in order to meet requirements for extended range instruments.

9 Claims, 3 Drawing Sheets

Fig. 3A
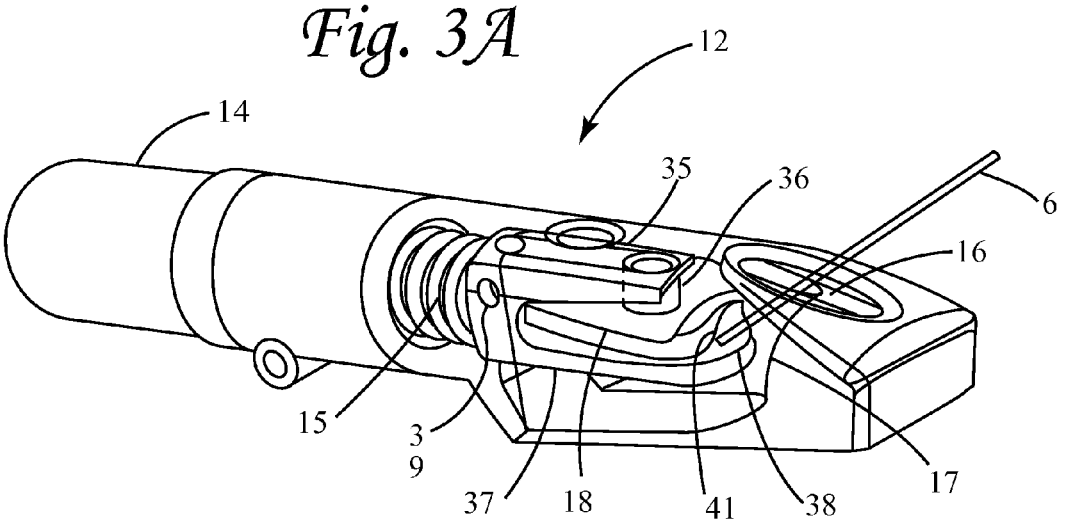
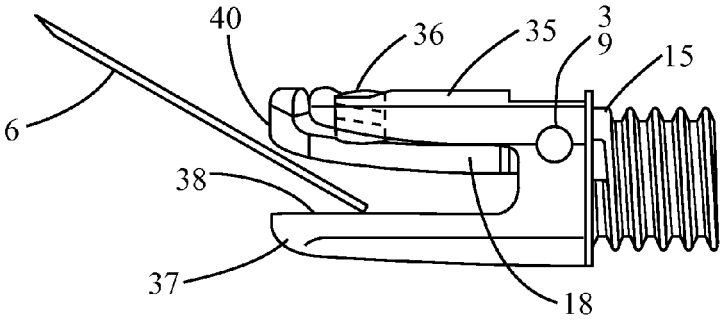
Fig. 3B
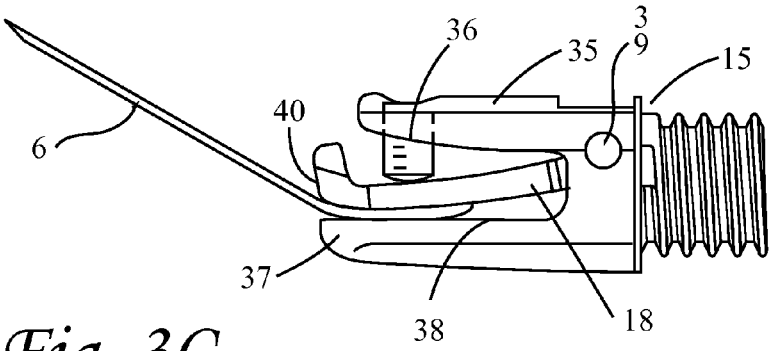
Fig. 3C

BI-DIRECTIONAL LOADING CLAMP IMPROVEMENT

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9" and 16".

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from 0.007" to 0.070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Additionally, the popularity of guitars and other multi-stringed instruments having more than the typical 6 strings and/or using longer scale lengths, baritone guitars, for example, etc. are capable of a greater pitch range which creates the need for strings of a larger diameter. One solution is to utilize "taper core strings" that have one or two less layers of wrap near the "ball end" of the string to go over the bridge elements. Further, a "taper wound" string simply tapers away these layers of wrap as near the ball-end of the string, so the part that goes over the bridge has a smaller diameter. "Exposed core" strings taper down to the core itself, so the core goes over the bridge and lowers the action and increases sustain/resonance. These designs are often seen on B strings, typically a low string on a five string bass, for example. The logic is that a taper core string, etc. approach will help with intonating a larger diameter string. In some of these cases the strings are mounted to tailpiece portion by inserting the string over the bridge element to avoid complications due to increased string diameter. The larger diameters can be problematic given the dimensions of vintage systems.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146 ("Fender '146") shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of Fender '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

The fulcrum tremolo is generally defined to have a base plate pivotally mounted to the body of the instrument and an "inertia block" or "tone block" or "spring block" that extends transverse the direction of the strings 90° to the base plate. The instrument body is fashioned to include a body cavity comprising an approximate 3.00"×1.00", generally rectangular, traditional "tremolo pocket" or "trem pocket" extending generally perpendicular from the top surface of the body to meet at 90°, the traditional, generally rectangular, approximate 4.00"×2.25"×0.775" deep, cutout extending in the direction of the strings in the back of the instrument body, a "spring pocket", to receive the spring arrangement. The typical spring arrangement includes, in addition to the biasing springs connected to the spring block, a "spring claw" to receive the other end of the biasing element secured by two wood screws to adjust the position of the spring claw relative to the body for a simple but cumbersome adjustment method. There is ample room for the spring block to pivot freely within the cavity during use. Although there are differences in specifications from one instrument manufacturer to another for the various designs of the fulcrum tremolos that are available, there is approximately 0.125 to 150" clearance, between the spring block and the cavity face closest to the nut, to provide for upward pitch change as the spring block pivots towards the nut.

Typically, in order to facilitate the fulcrum tremolo pivoting about its fulcrum axis, counter springs, as a biasing element, are utilized to counteract or counter balance the pull of the strings. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning. This is especially problematic if a string breaks with this type of tremolo; since the missing force otherwise created by the tension of the broken string allows the entire tremolo to be subject to the known "backward tilt", all the remaining strings are un-manageably sharp in pitch and the harmonic relationship to the fret placement and scale length is distorted, generally, to an undesirable degree.

This singular characteristic adds complexities in obtaining the primary goal of achieving a stable equilibrium between the force of the tension provided by the two to five biasing or counter springs (connected between the tremolo and the body) in relation to the force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Initial position refers to the position of the fulcrum tremolo and, therefore, the position of the second critical point on the bridge elements in relation to the first critical point on the nut such that the tension of the strings, each at the intended proper pitched condition, and the appropriately tensioned counter springs, renders a specific equilibrium point wherein the harmonic tuning for all the strings is simultaneously achieved. Often the pivot is subject to wear and the tremolo does not always return to its initial position. Great care is required to establish the initial position, since both aspects of adjustment are interactive for "floating tremolo setups", and since it simultaneously provides both the proper harmonic tuning and proper pitch tuning for each of the individual strings in order to enable a lasting "initial setup".

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos, as originated by Fender U.S. Pat. No. 2,741,146, when pivoted:

Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

- The bridge and tailpiece portions simultaneously move about the fulcrum axis when the device is pivoted for the tremolo effect;
- The fine tuner screws simultaneously move with the bridge and tailpiece portions about the tuning axis when fine tuning; and
- Fine tuners are designed to offer the tuning of the strings a minor adjustment of pitch after the general tuning is first achieved, typically, by the tuning pegs on the head of the instrument; and
- Adjusting the tension of a string by the fine tuner knob alone simultaneously adjusts the harmonic and pitch tuning and can achieve tuning a string to proper pitch conditions while simultaneously achieving proper harmonic tuning.

Knife Edge Pivots for the Fulcrum Tremolo

Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a "floating tremolo", for example, and offered the novel possibility to substantively increase the tension of the string for upward pitch changes by rocking the base plate "rearward towards the body" with the arm. The inclusion of iterations of Fender '146, herein referred to as Type I, to include, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 70/80's, are in part distinguished by the differing standards for the placement of the riser posts, that receive each of the knife-edges to create a pivot axis, relative to both first critical point on the nut as well as the second critical point on the bridge element. Accordingly, there are differences in the body pocket but less so for the cutout that receives the biasing springs and the distance from the face of the spring block nearest the nut to the corresponding face of the tremolo pocket.

Clamping Mechanisms

String clamps or locks are known on stringed musical instruments—some clamping mechanisms are substantial enough to secure the string to the instrument, but most often the device is supplemented by securing the string in combination with the ball end of the string, for example, or in combination with the tuning pegs. String locks are also arranged as a nut assembly, a "locking nut", so that after the ball-end is cut off and the resulting "plain" end is clamped in the tremolo, the other end of the string is threaded through the "locking nut" to extend to the tuner for tensioning before clamping the string for play.

In most instances, the direction the string takes during installation, following the tradition, begins at the tailpiece and proceeds to the tuning pegs for tensioning. For example, the ball-end is cut off for a vintage Type II-style tremolo, before inserted into the clamp in the only way possible, comprising the tailpiece, and then bent to a position over the neck, etc. Similarly, Fender '146, threads the strings through the spring block comprising the tailpiece, the base plate and the bridge elements in one direction to first secure the ball-end in the spring block before it is finally bent into position over the fret board, etc.

Other examples, include threading a string in a direction, starting at a tailpiece element towards the nut, to secure the ball end at the tailpiece, in general, and for some designs, under a clamp, usually positioned as close to the bridge element intonation point as is practically possible, where the stringbends up over the bridge element, continuing in the same direction, is positioned over the neck and then secured at the head. Specifically, McCabe U.S. Pat. No. 9,123,312 ("'312") FIG. 2 shows a novel locking macro-tuner arrangement wherein the string is first threaded through a tuner knob and extended towards the nut to engage the ball-end of the string at the end of a tuner pin that functions as a tailpiece. FIG. 3A of '312 depicts an open clamp position to receive the string therethrough from the direction of tailpiece portion 49 formed at second end 46 of tuning pin 50 and FIG. 3B of '312 depicts a closed clamped having successfully secure the string to the macro-tuner and, thereby, the instrument.

In these several instances, it would be impossible to thread the strings from the opposite direction, in any practical terms, since successful mechanisms are designed to create a purpose-driven single-direction string path that takes into consideration the shapes of any loose or un-tightened clamp elements, if any, as well as related and associated parts including, among other things, constrained string passageways—generally speaking, threading a string from the opposite direction runs into un-anticipated obstacles making a reliable effort difficult, impractical or impossible. Additionally, instruments with vintage specifications and constraints, neither have the capacity for bi-directional loading/securing of the string to the bridge element/instrument, nor are further adequately formed to address the demands for larger diameter strings and string construction alternatives found on modern multi-stringed and/or longer scale instruments.

SUMMARY OF THE INVENTION

Bi-Directional Loading Clamp Improvement

The present invention is directed to improved string clamps, with the singular capacity to secure one end of the string to the instrument successfully under normal forces of tension, etc. without additional means, specifically formed so that the string can be successfully threaded into and/or through the clamp from at least two distinct, generally opposing, essentially dissimilar, directions; accordingly, the string can be inserted or threaded into the clamping device from one of two directions in order that the clamp element secures a string to the instrument.

A preferred embodiment for a dual-loading clamping device includes a forward end closer the nut and a rearward end further the nut. The clamping device further fashioned to be operable to receive a string inserted essentially unimpeded in a first direction, the first direction extending in the direction of the strings typically from the rearward end of the clamping device towards the nut as well as fashioned to be operable to receive a string inserted essentially unimpeded in a second direction, the second direction extending in the direction of the strings typically towards the rearward end of the clamping device from the nut in order to comprise a dual-loading string clamping apparatus.

Further, another object of the present invention is to provide an improvement, in a preferred embodiment, of the lever-like clamp design found in locking macro-tuners, to include, at least, a purpose formed extension to the tip of the lever articulated with a groove-like recess operable to successfully guide the string unimpeded to a position within the clamping feature from the second direction, generally opposite to traditional methods, operable to clamp and, thereby, secure the string to the instrument.

The string, first threaded though the nose slot or string opening over the bridge element and down a passageway, for example, and, in view of this instant application, threaded under the formed tip sufficiently to lift the clamp element so that string can be further positioned unimpeded under the clamp and secured; accordingly, the clamping element is operable to secure the string in the instances of being inserted into the clamping device from either the first direction or the second direction. Further, other existing clamping designs can be modified to create a second access provision, an access from a distinct second direction.

Additionally, directly inserting a "taper core", "taper wound' and "exposed core" string, without the ball-end, for example, past the string slot at the intonation point on the bridge element portion, into the clamping device sufficiently in length to the clamp successfully comprises a second loading or string threading access, and thereby, comprises the dual-loading clamp mechanism when the clamp is activated. Accordingly, the arrangement will address the difficulty of clamping an over-sized string through an otherwise restricted opening comprising vintage dimensions.

"Dual-Loaders" refers to a string clamping or locking device for a stringed musical instrument wherein the string can be inserted into the device from one of two dissimilar directions, before securing a string to the instrument for a "Bi-directional" string clamp.

DESCRIPTION OF THE DRAWINGS

In the drawings:

FIGS. 3A, B and C show the Bi-Directional improvement for the insertion of the string through the string slot. FIG. 3A shows the string tip being positioned at the tip of the clamp after being inserted through the string slot from the direction of the nut. FIG. 3B shows the clamping mechanism in profile to show the position of the string at the clamp. FIG. 3C shows the clamping mechanism in profile to show the string successfully inserted into the clamp and secured thereby. The improvement comprises an additional, non-traditional, "bi-directional" string installation feature.

DETAILED DESCRIPTION OF THE INVENTION

Figure 1:
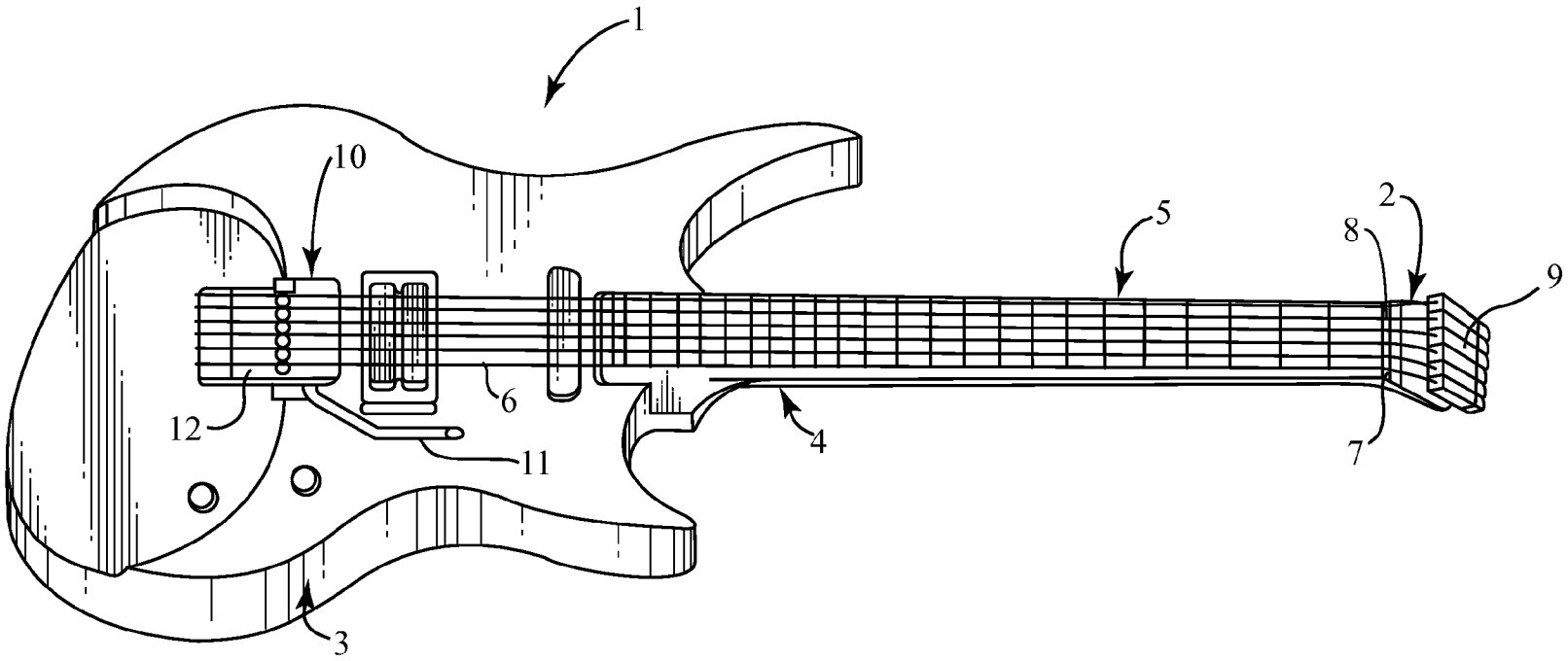
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extends from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted to achieve the desired tremolo effect.

Intonation module 12, shown as a macro-tuner, incorporating the function of bridge or saddle and tailpiece elements, is provided to support string 6. Intonation module 12 is slideably adjustable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, improvements for fulcrum tremolo 10 will be described in greater detail.

Figure 2:
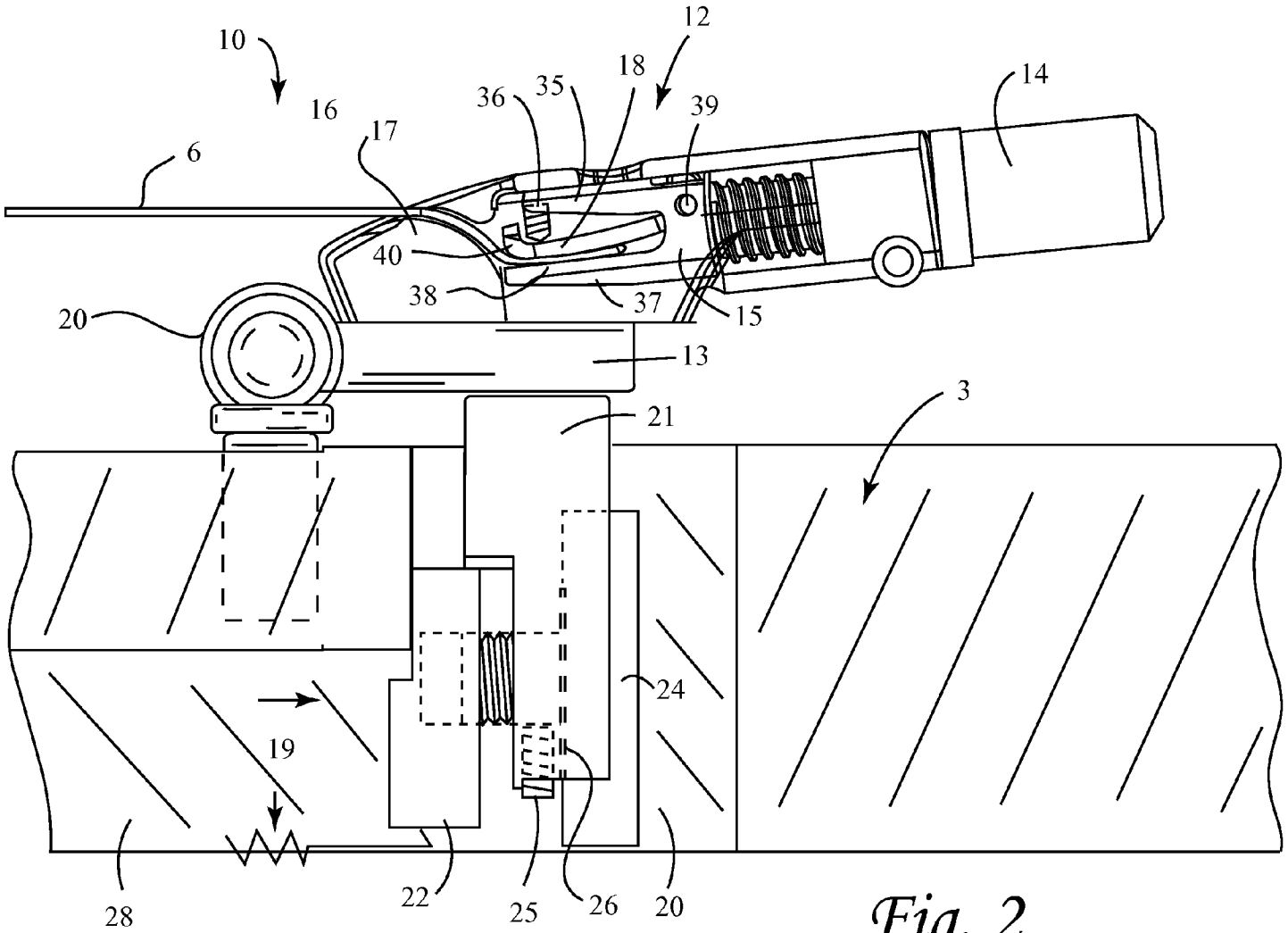
FIG. 2 is a side view of the tremolo mechanism showing the dual loading locking macro-tuner improvement as well as a spring holder element advanced towards main inertia block to stop a tremolo. The improved locking macro-tuner mechanism comprising a formed tip of the extended laver-clamp improvement including an articulated groove-like recess to facilitate threading a string through the nose slot to pivot or lift the clamp lever for successful loading of the string from a direction opposite or distinct from the traditional direction of operation carried out from the direction the tailpiece portion securing the string to the instrument. The string clamping device shown with a string successfully threaded or inserted essentially unimpeded into the clamping device from a second direction, the second direction generally opposite the first direction, the second direction extending in the direction of the strings from the nut towards the rearward end of the clamping device. The dual-loading device can comprise a tailpiece element to complement the bridge elements on the body.

FIG. 2 features fulcrum tremolo 10 in a partial cross-section side view showing body 3 further comprising tremolo pocket 28 and tremolo spring pocket 29, spring block arrangement comprising main block 21, holder element 22, extended portion 23, thumbwheel 24, set screw 25 and washer 26 and locking macro-tuner 12. Second critical point 16 is located on intonation module 12 at string opening 17. The leading-edge portion of base plate 13 (not shown), the area closest to nut 7, can comprise bearing housings 20. Bearing arrangement 20 adjustably supports base plate 14 pivotally relative to body 3.

Further, fulcrum tremolo 10 comprising dual loading locking macro-tuner 12 comprising lever-clamp 18 pivotally connected to tuner pin 15 on pivot pin 39. String 6 is shown inserted over bridge element 16 through string slot 17 into upper clamping portion 35 and lower clamping portion 37 of tuner pin 15, lower clamping portion 37 further comprising lower clamping surface 38. Setscrew 36 is threadedly connected to upper clamp portion 35 to clamp string 6 between lever-clamp 18 and clamping surface 38. String 6 is shown following string guide 41, extended under extended tip 40, formed to be operable to receive string 6 first threaded through nose string slot 17. String 6 threaded in an alternative direction from the direction of nut 7 (not shown) and successfully clamped as shown.

FIG. 3A shows a perspective view of dual loading locking macro-tuner 12 comprising lever-clamp 18 pivotally connected to tuner pin 15 on pivot pin 39. String 6 is shown inserted over bridge element 16 through string slot 17. Tuner pin 15 comprising upper clamping portion 35 and lower clamping portion 37, lower clamping portion 37 further comprising lower clamping surface 38. Setscrew 36 is threadedly connected to upper clamp portion 35 operable to clamp string 6 between lever-clamp 18 and clamping surface 38. String 6 is shown following string guide 41, extended under extended tip 40 formed to be operable to receive string 6 first threaded through nose string slot 17, to provide access from the direction of nut 7 (not shown).

FIGS. 3B and 3C show further detail in profile on the dual loading clamp improvement. FIG. 3B shows string 6 having been inserted, as in FIG. 3A, following string guide 41 (not shown in this perspective) sufficiently under tip 40 to lift lever-clamp 18. FIG. 3C shows string 6 having been further threaded unimpeded under the lifted tip 40 and fully positioned between clamp-lever 18 and clamp lower portion 37. Setscrew 39 adjusted to clamp string 6 between upper clamp portion 35 and lever-like clamp 18 to secure string 6. Accordingly, in addition to the traditional installation of string 6 to secure the ball-end (not shown) through the tuner knob 14 to tuner pin 15, the improvement comprises an additional, non-traditional, "bi-directional" string installation feature or "dual-loading" improvement.

The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

I claim:

1. An apparatus for a stringed musical instrument, the stringed musical instrument comprising a body and a neck, a plurality of strings extending from the body to the neck, a nut for supporting the plurality of strings on the neck forming a first critical point for each string, a bridge element forming a second critical point for supporting each of the strings on the body wherein the apparatus comprises a clamping device for a string positioned on the opposite side of the bridge element relative to the nut, the string comprising one string of the plurality of strings, the clamping device with the singular capacity to secure one end of the string to the instrument body successfully under normal forces of tension, etc., the clamping device further comprising a forward end closer the nut, and a rearward end further the nut, the apparatus comprising:

a clamp element, the clamp element variably connected to the clamping device, the clamp element comprising a first surface and a second surface, a connected end and a free end, the free end comprising a tip, an adjustment element variably connected to the clamping device and the first surface of the clamp element, adjusting the adjustment element is operable to position the second surface of the clamp element to secure a string, wherein the improvement comprises the apparatus formed operable to:

receive the string inserted essentially unimpeded into the clamping device in a first direction, the first direction extending in the direction of the strings from the rearward end of the clamping device towards the nut, or, receive the string inserted essentially unimpeded into clamping device from a second direction, the second direction generally opposite the first direction, the second direction extending in the direction of the strings from the nut towards the rearward end of the clamping device, the clamp element operable to secure the string inserted into the clamping device from either the first direction or the second direction.

2. The apparatus of claim 1 wherein the clamp element is extended towards the nut to comprise an extension to the tip of the lever, the extension comprising a groove-like recess, the groove-like recess operable to guide the string, inserted from the second direction, to a position under the second surface within the clamping device to secure the string to the body.

3. The apparatus of claim 1 further comprises a macro-tuner for, at least, tensioning a string from an untensioned condition to an adjustable tension, and therefore, a pitch for play.

4. A string clamping device for a stringed musical instrument, the stringed musical instrument further comprising a body, a neck extending outwardly from the body, a plurality of strings extending in a direction from the body to the neck, a nut on the opposite end of the neck from the body forming a first critical point for each of the strings, a bridge element to support the strings over the body forming the second critical point for each of the strings, the bridge element further comprising a base element, a tuning element connected to the base element operable to tension a string, the base element slideably connected to the body operable to adjust harmonic tuning, the tuning element further comprises a tuner adjustment knob, the tuner adjustment knob threadedly connected to the tuning element, the string clamping device further comprising a clamp housing element, the clamp housing element comprising a housing axis, the housing axis transverse the direction of the strings, the string clamping mechanism further comprises: a forward end, the forward end closer the nut, the string clamping device comprising internal surfaces, the internal surfaces formed within the clamp housing element, the internal surfaces comprising an upper surface and a lower surface, the upper surface further the body, the lower surface closer the body, a lever element pivotally aligned to the housing axis, the lever element operable to secure a string to the musical instrument, the lever element comprising: a first surface and a second surface, the first surface of the lever element extending in the direction of the strings closer the upper surface, the second surface extending in the direction of the strings closer the lower surface, an adjustment element, the adjustment element threadedly connected to the clamp housing element, variably connected to the first surface, threading the adjustable element operable to pivot the lever element on the housing axis to secure the string, wherein the improvement comprises the string clamping device further formed operable to:

receive the string inserted essentially unimpeded into the clamping device in a first direction, the first direction extending in the direction of the strings from the rearward end of the clamping device towards the nut, or, receive the string inserted essentially unimpeded into clamping device from a second direction, the second direction generally opposite the first direction, the second direction extending in the direction of the strings from the nut towards the rearward end of the clamping device, the clamping element operable to secure the string inserted into the clamping device from either the first direction or the second direction.

5. Apparatus of claim 4 wherein the tuning element comprises a fine-tuning mechanism.

6. Apparatus of claim 5 wherein the tuning element comprises a macro-tuner for, at least, tensioning a string from an untensioned condition to an adjustable tension, and therefore, a pitch for play.

7. A stringed musical instrument comprising a body and a neck, a plurality of strings extending from the body to the neck, a nut for supporting the strings on the neck forming a first critical point for each string, a bridge element forming a second critical point for supporting the strings on the body, an apparatus located on the body on the opposite side of the bridge element from the nut, wherein the apparatus further comprising a clamping device for a string, the clamping device comprising a clamp housing element, the clamp housing element further comprising:

a housing axis, the housing axis transverse the direction of the strings, a forward end, the forward end closer the nut, the forward end comprising an enlarged opening, the enlarged opening forming internal surfaces, the internal surfaces within the clamp housing element, the internal surfaces further comprising an upper surface and a lower surface, the upper surface further the body, the lower surface closer the body, a lever-like element, the lever-like element comprising a first end, a second end and a middle portion, the first end furthest the nut, the second end closest the nut, the lever-like element pivotally connected to the clamp housing element, lever-like element comprising a first surface and a second surface, the first surface extending in the direction of the strings closer the upper surface, the second surface extending in the direction of the strings closer the lower surface, the second end further comprising an extension, the extension extending in the direction of the nut, the extension comprising a groove-like recess, the groove-like recess operable to guide the string, inserted from the second direction, to a position under the second surface within the clamping device to secure the string to the body an adjustment element, the clamping element threadedly connected to the clamp housing element, variably connected to the first surface operable to position the lever-like element within the clamp housing element to secure the string between the lower surface and the second surface, wherein the string clamping device further formed operable to:

receive a string inserted essentially unimpeded into the clamping device in a first direction, the first direction extending in the direction of the strings from the rearward end of the clamping device towards the nut, or receive the string inserted essentially unimpeded into clamping device from a second direction, the second direction generally opposite the first direction, the second direction extending in the direction of the strings from the nut towards the rearward end of the clamping device, the clamping element operable to secure the string inserted into the clamping device from either the first direction or the second direction.

8. Apparatus of claim 7 wherein the tuning element comprises a fine-tuning mechanism.

9. Apparatus of claim 7 wherein the tuning element comprises a macro-tuner for, at least, tensioning a string from an untensioned condition to an adjustable tension, and therefore, a pitch for play.

* * * * *